US007775743B1

(12) United States Patent
Kelley

(10) Patent No.: US 7,775,743 B1
(45) Date of Patent: Aug. 17, 2010

(54) EROSION CONTROL DEVICE AND METHOD OF USE

(76) Inventor: Dennis G. Kelley, 235 Wright Ave., Houma, LA (US) 70364

( * ) Notice: Subject to any disclaimer, the term of this patent is extended or adjusted under 35 U.S.C. 154(b) by 73 days.

(21) Appl. No.: 11/763,260

(22) Filed: Jun. 14, 2007

Related U.S. Application Data

(60) Provisional application No. 60/814,106, filed on Jun. 14, 2006.

(51) Int. Cl.
*E02D 17/20* (2006.01)

(52) U.S. Cl. ..... 405/19; 405/302.7

(58) Field of Classification Search ..... 405/302.6, 405/19, 20
See application file for complete search history.

(56) References Cited

U.S. PATENT DOCUMENTS 5,651,641 A * 7/1997 Stephens et al. ..... 405/302.6
6,793,858 B2 * 9/2004 Motz ..... 264/172.19
7,284,930 B2 * 10/2007 Shi et al. ..... 405/129.1

FOREIGN PATENT DOCUMENTS

CA 1233329 A * 3/1998
JP 60-16607 * 1/1985
JP 10148095 A * 6/1998

* cited by examiner

*Primary Examiner*—John Kreck
(74) *Attorney, Agent, or Firm*—Warner J. Delaune; Baker Donelson Bearman Caldwell & Berkowitz, P.C.

(57) ABSTRACT

An erosion control device is provided, comprising a panel having a concrete matrix having a top surface and a bottom surface; a turf reinforcement material contained within the concrete matrix; and a geotextile material bonded to the bottom surface of the concrete matrix. The device includes a plurality of shear connectors inserted through the geotextile material, the concrete matrix, and the turf reinforcement material, and at least one flap of geotextile material extending along an edge of the device for overlapping by adjacent panels. The top surface includes score lines adapted to permit the panel to crack and bend along the score lines to adapt to uneven terrain, and also includes installation holes adapted to anchor the device to a levee or shoreline.

14 Claims, 3 Drawing Sheets

SECTION A-A

SECTION B-B

EROSION CONTROL DEVICE AND METHOD OF USE

CROSS-REFERENCE TO RELATED APPLICATIONS

This Non-Provisional Patent Application, filed under 35 U.S.C. §111(a), claims the benefit under 35 U.S.C. §119(e)(1) of U.S. Provisional Patent Application No. 60/814,106, filed under 35 U.S.C. §111(b) on Jun. 14, 2006, and which is hereby incorporated by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to ground surface covers, including devices and methods employed to reduce the erosion of levees and shorelines from wave action and currents, and more particularly to erosion control devices which are anchored into the soil to form a continuous mat parallel to the shoreline.

2. Description of Related Art

In the United States and other countries, miles of shorelines, beaches, and levees are annually subjected to severe erosion which literally washes away earth and exposes higher ground and valuable property to wave action and flooding. The problem is particularly of concern to residences and industries located near vital waterways bounded by levee systems, such as the Mississippi River and its tributaries. If left unchecked, wave and current action erodes and undermines the foundation of levees, leading to a weakening and ultimate failure of such levees during times of high water or storm surge.

Currently, commonly used methods of effectively controlling erosion involve the placement of a ground cover on top of and along the surface of interest, of an area extending the region of desired erosion control. The main objective of placing ground cover is to adequately control or minimize the movement of earthy or rock material along the surface of the ground, whatever the cause of the movement. In terms of functionality, there are several important properties for a ground surface cover system to have in order to be effective. Foremost, an effective ground surface cover system needs to be made of sufficient strength and long term stability to withstand one or more of the elements causing erosion processes such as wave action and current flow over long periods of time.

Several different types of ground surface cover systems are in common use. In addition to partially or completely covering the selected area of ground surface requiring erosion control with a multitude of removable individual elements, four main categories are ordinarily referred to with respect to ground surface cover systems, i.e., single cast structures, multi-cast structures, 'gabion' structures, and combination structures. Single cast ground surface cover systems are based on permanently covering the selected area of ground surface requiring erosion control with a layer of concrete alone, or, with a layer of concrete containing a dispersion of stones. Optional metal reinforcements internal to the cover material may be used throughout selected portions of the ground surface cover system. Multi-cast ground surface cover systems are based on the placement of a multitude of removable individual geometrically formed elements or blocks usually made from concrete, which partially or incompletely cover the selected area of ground surface requiring erosion control. Gabion ground surface cover systems are based on the placement of gabion structures, featuring a continuous or discontinuous network or web like structured system of metal baskets or cages of specified geometries, dimensions, and rigidity, filled with a chosen density of loose, non-cemented stones. Combination ground surface cover systems are based on the placement of a plastic matting featuring concrete casting modules, typically of a honeycomb like geometry, upon the ground, and casting, on-site, the concrete modules. Individual concrete modules are relatively near to, but are not in contact with, each other.

Multi-cast ground surface cover systems may be further classified into two different types, i.e., systems based on interconnecting elements or locks, and systems based on interlocking elements or blocks. Hereinafter, "interconnecting" refers to the state or configuration of elements or blocks placed side-to-side or adjacent to each other, thereby forming a larger non-flexible pattern of such elements or blocks, where the elements or blocks are connected, and not locked, even loosely, to each other via element to element or block to block male to female connection or mating of any sort. Hereinafter, "interlocking" refers to the state or configuration of elements or blocks which are placed in contact with each other via some sort of element to element or block to block male to female interlocking connection or mating, thereby forming a larger non-flexible or flexible pattern of such elements or blocks, where the elements or blocks are locked to each other. In this case, the interlocking connection or mating between any two elements or blocks forms a joint, where the joint is comprised of a male component structural feature such as a hook, protrusion, extension, barb, tongue, or nose, compatible with and interlocked to a corresponding female component structural feature such as a recess, opening, or related cutout structural feature. According to present usage, an interlocking element to element or block to block joint may be non-flexible or flexible, whereby flexibility refers to the capability of movement or turning in a horizontal or vertical direction without damaging or breaking the interlocking joint, or the elements or blocks.

In regard to multi-cast ground surface cover systems, current teachings of interlocking ground surface cover systems are based on individual elements interlocked by rigid or fixed, non-flexible joints between the elements, resulting in no degrees of freedom for vertical or horizontal movement. This characteristic of multi-cast interlocking element systems presents several significant limitations for application of such systems to erosion control, not the least of which are the tediousness of installation of great numbers of small elements to one another, and the difficulty of removing and replacing individual elements over time.

An ideal ground surface cover system for effective erosion control would feature all the above mentioned properties and attributes necessary for achieving the objective of adequately controlling or minimizing ground movement during a potential erosion process, including high strength and long term stability, flexible adjustment to ground movement, economic and feasible manufacturing and installation, replaceability, and reusability. It will be shown that incorporating the feature of flexibility into a ground surface cover system leads to significantly better achievement of having all of these properties and attributes of an effective erosion control system.

BRIEF SUMMARY OF THE INVENTION

Therefore, one object of the present invention is to provide an erosion control device which effectively reduces the extent of erosion of shorelines and levees.

It is also an object of the present invention to provide an erosion control device and method of use which is conformable to terrain variations.

A further object of the present invention is to provide an erosion control device which is extremely durable and long-lasting.

Yet another object of the present invention is to provide an erosion control device and method of use which is simple and quick to apply.

Accordingly, an erosion control device is provided, comprising a panel having a concrete matrix having a top surface and a bottom surface; a turf reinforcement material contained within the concrete matrix; and a geotextile material bonded to the bottom surface of the concrete matrix. The device includes a plurality of shear connectors inserted through the geotextile material, the concrete matrix, and the turf reinforcement material, and at least one flap of geotextile material extending along an edge of the device for overlapping by adjacent panels. The top surface includes score lines adapted to permit the panel to crack and bend along the score lines to adapt to uneven terrain, and also includes installation holes adapted to anchor the device to a levee or shoreline.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
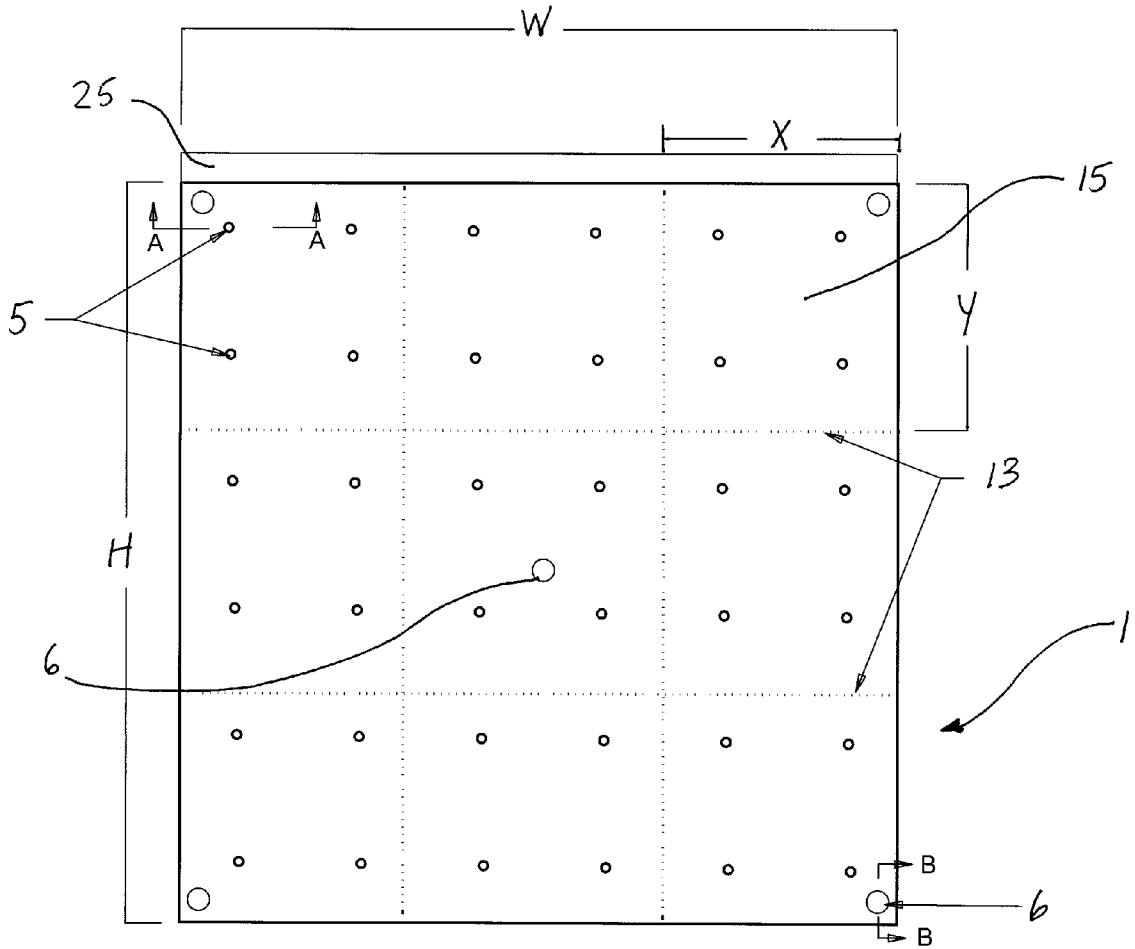
FIG. 1 depicts a top view of a preferred embodiment of an erosion control element in accordance with the present invention.
Figure 2:
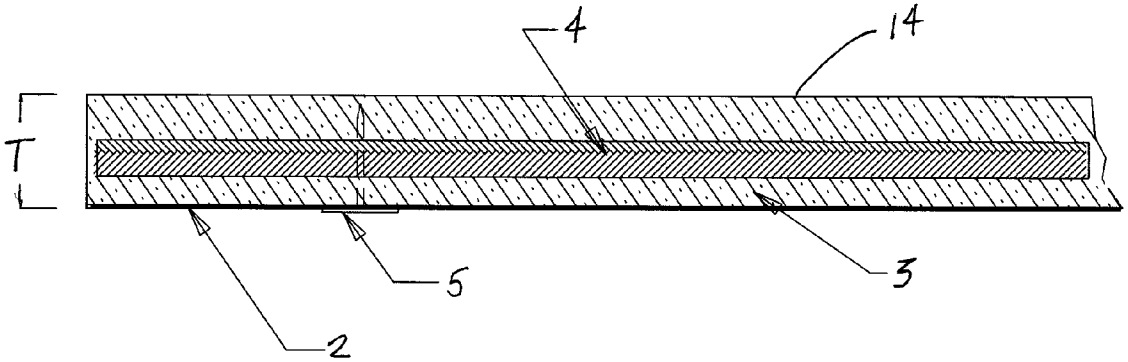
FIG. 2 depicts a sectional view of the erosion control element of FIG. 1 at Section A-A.
Figure 3:
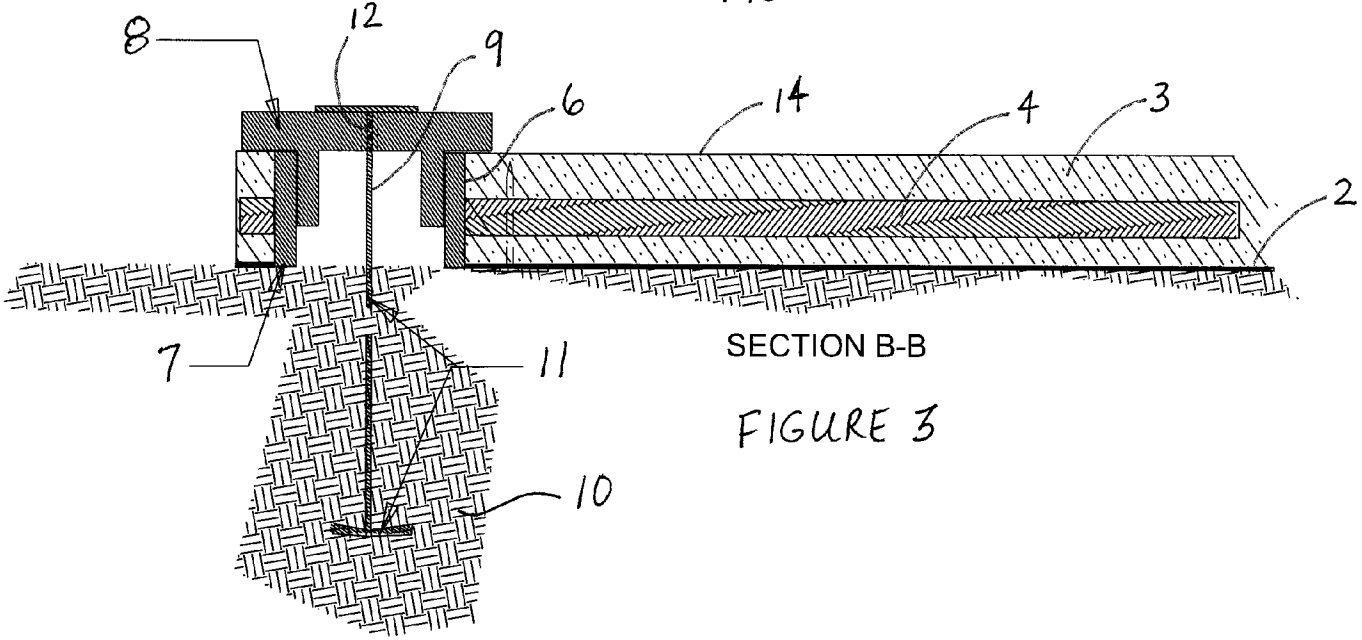
FIG. 3 depicts a sectional view of the erosion control element of FIG. 1 at Section B-B.

Turning now to FIGS. 1-3, a preferred embodiment of the invention is shown to comprise a rectangular shaped erosion control element 1 having width W and height H, which is generally constructed from a bottom layer of geotextile material 2, a concrete matrix 3, and a high performance turf reinforcement material or mat (TRM) 4 residing within the concrete matrix 3. Although the dimensions of the erosion control element 1 are subject to change depending upon the specific application and needs of the situation, a typical element 1 is roughly eight feet by eight feet (8'×8').

The geotextile material 2 is preferably a woven or non-woven engineering fabric having perforations to allow the drainage of water and the passage of roots from underlying vegetation, so as to promote soil stabilization. As used herein, the term "geotextile" means a product used as a soil reinforcement agent and as a filter medium, typically made of synthetic fibers manufactured in a woven or loose non-woven manner to form a blanket-like product. One example of such a material is the Geotex® product manufactured by Propex, Inc., of Chattanooga, Tenn., although products of similar functionality may also be employed. The turf reinforcement material 4 is preferably a "high performance" TRM or three-dimensionally woven material such as the Pyramat®product also manufactured by Propex, or possibly a TRM known as Green Armor™ or Enkamat® manufactured by Profile Products LLC of Buffalo Grove, Ill.

The element 1 includes a plurality of shear connectors 5 inserted from the bottom of the element 1, through the geotextile material 2, wherein each shear connector 5 extends at least through the turf reinforcement material 4. The shear connectors 5 may be plastic or metal, such as in the form of tacks, and they are preferably inserted through the geotextile material 2 prior to the application of the concrete matrix 3 during fabrication, as will be explained further herein. While the specific pattern or number of shear connectors 5 is not particularly important, the pattern and number of shear connectors 5 as illustrated in FIG. 1 has been proven to be effective for most purposes. In this manner, the shear connectors 5 serve to assist in the prevention of horizontal displacement of the geotextile material 2 and the turf reinforcement material 4 relative to the concrete matrix 3, in addition to the bonding strength that exists between such layers by virtue of the concrete matrix 3 itself.

In a preferred embodiment, the element 1 includes a plurality of installation holes 6 through which soil anchors 9, well known in the art and possibly provided by Platipus Anchors Limited, may be inserted to lock the element 1 to the soil 10 of the shoreline or levee. Soil anchors 9 include a shaft and anchoring portion 11 which expands when inserted to prevent inadvertent removal due to expected wave action and vibratory movement of the element 1 over time. Each installation hole 6 is provided with a grommet 7, preferably comprised of 1.5 inch ID Schedule 80 PVC, as well as a cap 8, preferably comprised of 1.5 inch OD Schedule 80 PVC, which includes a top hole 12 for insertion and retention of the soil anchor 9. While the specific pattern or number of installation holes 6 is not particularly important, the pattern and number of installation holes 6 as illustrated in FIG. 1 has been proven to be effective for most purposes, namely one at each corner of the element 1 and a fifth one in the center of the element 1.

As will be further explained below, the element 1 is also scored to form roughly ¼" inch deep scores 13 into the top surface 14 of the concrete matrix 3, such that a plurality of sub-elements 15 are established of dimension X by Y. If desired, the scoring may also be formed to a depth just above the turf reinforcement material 4. For elements 1 which are of the typical 8'×8' size, a total of nine equal size sub-elements 15 may be created, resulting from two vertical scores and two horizontal scores. It should be understood that scores 13 may be placed at any location on the element 1 if a different size or number of sub-elements 15 is desired for the particular terrain. When the scores 13 are produced, the concrete matrix 3 is permitted to crack along the score lines 13 such that each sub-element 15 may bend through the turf reinforcement material 4 relative to other adjacent sub-elements 15. In most cases, the angular bending of each sub-element 15 relative to its adjacent sub-elements 15 should be approximately 10-20 degrees, such that when the element 1 is placed upon the levee or shoreline, natural variations in grade may be accommodated while still providing the required protection. Due to the stretching of the geotextile material 2 and the turf reinforcement material 4 that occurs through such bending, it is preferred that each sub-element 15 include at least four shear connectors 5 to prevent substantial lateral displacement of those materials relative to the concrete matrix 3.

Figure 4:
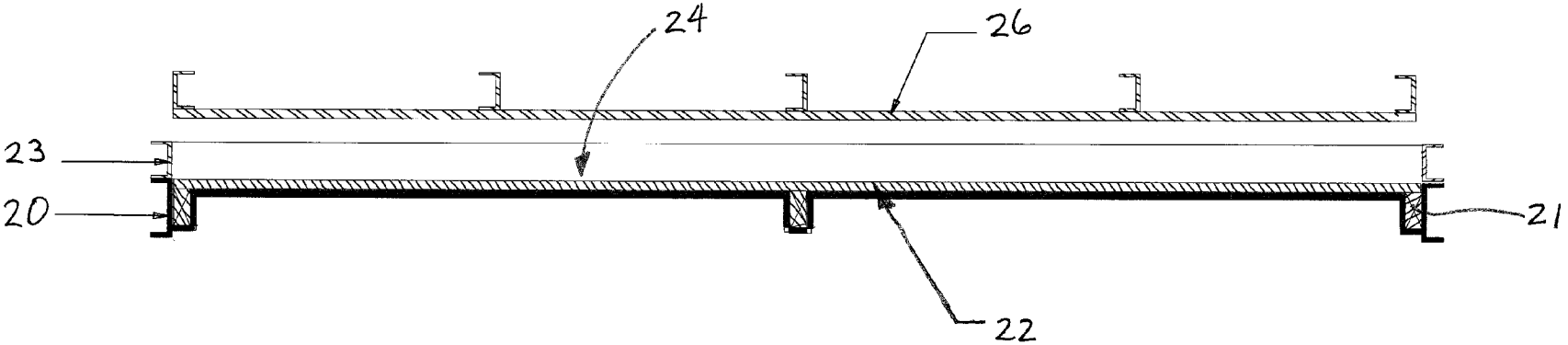
FIG. 4 depicts a sectional view of a preferred embodiment of an assembly used to fabricate the erosion control element of FIG. 1.

Referring now to FIG. 4, a method of fabrication of the erosion control element 1 is described. An anvil base 20, preferably constructed from heavy steel, is formed as a rigid structure to contain a selection of wood boards and plywood to establish a pallet 24 on which the element 1 will be constructed. The anvil base 20 should be strong enough to withstand the stresses imparted to it by the compaction and casting step as explained below. For example, standard 2×4 boards 21 may be inserted into the anvil base 20, upon which is placed one or more large plywood sheets 22, such as two 4×8¾" plywood sheets, to comprise the size of the element 1 to be fabricated. The pallet 24 is preferably coated with an epoxy paint to prevent the concrete from adhering to the pallet 24 during the curing process.

Once the pallet 24 is in place, the shear connectors 5 are driven through the geotextile material 2 in the desired locations, and then the geotextile material 2 is laid upon the pallet 24 such that the shafts of the shear connectors 5 are pointed in an upward direction. The size of the geotextile material 2 should be such that at least one flap 25 is allowed to extend outside of the mold 23 fully along at least one side of the element 1. The flap 25 is required for installation so that each element 1 is caused to rest upon the flap 25 of an adjacent element 1, thereby creating an overlapping layer of geotextile material 2 when the elements 1 are installed onto the levee adjacent to one another in a row parallel to the shoreline. Typically, the flap 25 should be approximately 6-12 inches wide, depending on the extent of overlap desired. In some cases, it may be desirable to allow a second flap 25 on a second side of element 1 (oriented in a position 90 degrees from the first flap) in the event that multiple rows of elements 1 may be installed parallel to the shoreline, such as in cases where extremes of wave action or storm surge may be present.

Once the geotextile material 2 is laid down over the pallet 24, a rectangular mold 23 is placed upon the pallet 24 to receive the materials that will be used to construct the element 1. In one embodiment, the mold 23 is constructed from channel steel wherein the backside of the channel serves as the inside surface for the mold 23. Clamps (not shown) may be used to secure the mold 23 to the anvil base 20 as is common in similar fabrication methods.

In one method, a first layer of concrete 3 is poured into the mold 23, approximately ⅜" in thickness. Next, the turf reinforcement material 4 of approximately the same size as the area inside of mold 23 is laid on top of the uncured concrete 3. A second layer of concrete 3 is then poured over the turf reinforcement material 4 to a thickness of ⅜" to about ⅞" depending upon the strength required for the particular use of the element 1. The total thickness T of the element 1, therefore, should be approximately ¾" to about 1⅛" thick. The materials inside mold 23 are then allowed to cure for about a half hour to about one hour, after which the material is compacted with a plate compactor 26, typically constructed from steel plate and channel components as depicted in FIG. 4. The plate compactor 26 serves to compact the concrete 3 and may include vibratory equipment attached thereto to assist in the compaction process. The compaction and vibration serve to make the concrete mixture more dense, and it also forces the concrete into the woven fibers of the geotextile material 2 and the turf reinforcement material 4 to establish better bonding of those materials to the concrete matrix 3.

Alternatively, rather than pour a first layer of concrete 3, the turf reinforcement material 4 may be laid directly over the geoxtile material 2, allowing the shear connectors 5 to pierce the turf reinforcement material 4. Next, the concrete 3 may be poured over the turf reinforcement material 4 in a single step to about ¾" and then allowed to cure for about 15-30 minutes. Finally, the contents within mold 23 may be compacted and vibrated in the manner described above, until the turf reinforcement material 4 effectively "floats" into the concrete 3 above. Again, this compaction and vibratory step also serves to increase the bond between the concrete and the materials as the concrete settles within the voids, cracks, and interstices of the materials.

Although different mixtures for the concrete matrix 3 may be used, a preferred mixture proven to be effective is about 400-500 pounds of sand, 150-200 pounds of cement, 75-120 pounds of water, a water-reducing additive, a fiber reinforcement additive (such as steel, glass fibers, or plastic fibers), and 3-6% latex additive by weight. The actual mix ratios will be determined based upon the use of the elements 1 and the strength demands of the environment in which they are employed. However, a minimum design strength in compression should be approximately 2500 psi. Typical slump for the aforementioned mix varies between about one and three inches. The sand used for the mix consists typically of concrete sand mixed with a minus 40 sieve component (approximately 5%), although natural sands have also been successfully used.

After the element 1 is fabricated, mold 23 can be removed once the concrete 3 has sufficiently hardened, and the element 1 can be transported on its pallet 24 to a curing location where it is allowed to cure for an additional 24 hours or more. Preferably, the curing conditions provide high humidity at about 80-90 degrees Fahrenheit. Once fully cured, the element 1 may be stored on its own pallet 24, or removed from its pallet 24 and stacked with other completed elements 1 using suitable spacers. Moving the elements 1 during transportation and installation is best achieved using a hoist and spreader bar having cables or ropes attached through the four corner installation holes 6, during which time the element 1 will flex and bend as expected due to the scoring operation described above.

The invention described herein can compensate for slightly uneven shorelines, such that the natural settling of the elements 1 will serve to level the underlying ground over time. In addition, a friction pattern or other traction surface can be applied to or formed into the top surface 14 in a manner that the erosion control device may also serve as a ramp for use with boat trailers. The invention also has particular utility in the protection of shorelines on barrier islands of Louisiana and other states bordering on the Gulf of Mexico. Furthermore, the invention may be used on steep river levees and similar structures, as well as for canal linings in navigable waterways having high boat traffic and extensive problems with erosion.

It will be understood that each of the embodiments described above, or two or more together may also find a useful application in other types of methods differing from the type described above. Without further analysis, the foregoing will so fully reveal the scope of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; and the scope of the present invention is to be limited only by the following claims.

The invention claimed is:

1. An erosion control device, comprising a concrete matrix having a top surface and a bottom surface; a turf reinforcement material contained within said concrete matrix; a geotextile material bonded to said bottom surface of said concrete matrix; and a plurality of shear connectors inserted through said geotextile material and said turf reinforcement material; and further including a plurality of installation holes adapted to anchor said device to a predetermined location, wherein each of said installation holes include a grommet and a cap adapted to retain a soil anchor.

2. The device of claim 1, further comprising at least one flap of geotextile material extending along an edge of said device.

3. The device of claim 1, wherein said concrete matrix includes a fiber reinforcement additive.

4. The device of claim 1, wherein said concrete matrix include a latex additive.

5. The device of claim 1, wherein said turf reinforcement material includes is a three-dimensionally woven material.

6. The device of claim 1, wherein said geotextile material includes perforations for drainage of water therethrough.

7. The device of claim 1, wherein said top surface includes score lines adapted to permit said device to crack and bend along said score lines.

8. A method for controlling erosion, comprising:

(a) providing an erosion control device comprising a concrete matrix having a top surface and a bottom surface; a turf reinforcement material contained within said concrete matrix; a geotextile material bonded to said bottom surface of said concrete matrix; and a plurality of shear connectors inserted through said geotextile material and said turf reinforcement material; and further including a plurality of installation holes adapted to anchor said device to a predetermined location, wherein each of said installation holes include a grommet and a cap adapted to retain a soil anchor; and (b) anchoring a plurality of said erosion control devices along a shoreline location subject to erosion, such that each said erosion control device is anchored adjacent to at least one other said erosion control device to form a row of said erosion control devices in a direction parallel to said shoreline.

9. The method of claim 8, further comprising at least one flap of geotextile material extending along an edge of said device.

10. The method of claim 8, wherein said concrete matrix includes a fiber reinforcement additive.

11. The method of claim 8, wherein said concrete matrix include a latex additive.

12. The method of claim 8, wherein said turf reinforcement material includes is a three-dimensionally woven material.

13. The method of claim 8, wherein said geotextile material includes perforations for drainage of water therethrough.

14. The method of claim 8, wherein said top surface includes score lines adapted to permit said device to crack and bend along said score lines.

* * * * *